United States Patent [19]

Nichols et al.

[11] Patent Number: 4,638,818

[45] Date of Patent: Jan. 27, 1987

[54] METHOD OF MAKING A FILTER CIGARETTE

[75] Inventors: Walter A. Nichols; Reginald W. Newsome both of Richmond, Va.

[73] Assignee: Philip Morris Incorporated, New York, N.Y.

[21] Appl. No.: 804,042

[22] Filed: Dec. 3, 1985

Related U.S. Application Data

[60] Division of Ser. No. 582,600, Feb. 22, 1984, Pat. No. 4,570,649, which is a continuation-in-part of Ser. No. 429,354, Sep. 30, 1982, abandoned.

[51] Int. Cl.[4] ..... A24C 1/38

[52] U.S. Cl. ..... 131/281; 131/94; 131/95

[58] Field of Search ..... 131/281, 94, 95

[56] References Cited

U.S. PATENT DOCUMENTS 4,369,796 1/1983 Hall ..... 131/95

FOREIGN PATENT DOCUMENTS 2066130 7/1981 United Kingdom ..... 131/281

*Primary Examiner*—V. Millin

*Attorney, Agent, or Firm*—Jeffrey H. Ingerman

[57] ABSTRACT

A variable dilution filter cigarette is provided which includes a substantially cylindrical tobacco rod, an axially aligned, substantially cylindrical wrapped filter plug, and tipping paper which circumscribes the filter plug and joins the filter plug to the tobacco rod. The filter plug has first and second ends, which are open to permit the passage of air and smoke. The plug wrap is substantially air-impermeable and is divided into a mouth-end band, a central band, and a rod-end band having a first opening. The first and third bands are attached to the filter. The tipping paper is also substantially air-impermeable, circumscribes the filter plug, and extends from the mouth end of the filter plug to a position on the tobacco rod adjacent the rod end of the filter plug. The tipping paper is divided into first and second bands, the first band extending from the mouth end of the filter plug to a position overlying the rod-end band. The second band abuts the first band and overlaps and attaches the rod end of the filter plug to the abutting end of the tobacco rod. The first band is attached to the plug wrap only at the central band for rotation therewith about the longitudinal axis of the filter plug and has a second opening overlying the rod-end band such that the second opening is rotatable into registry with the first opening.

2 Claims, 8 Drawing Figures

FIG. 1
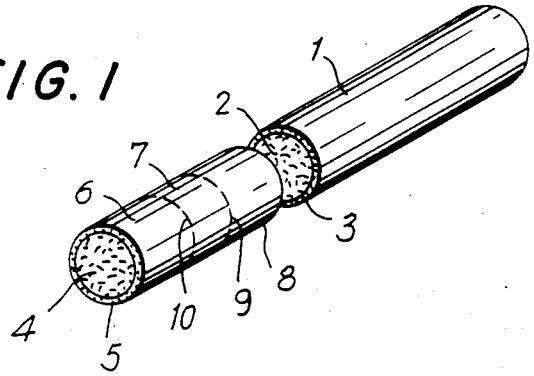
FIG. 2
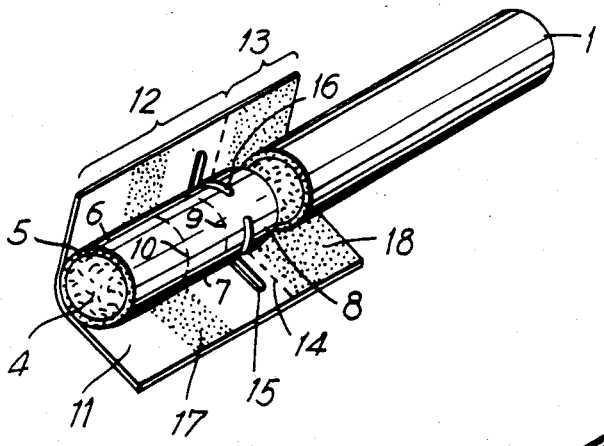
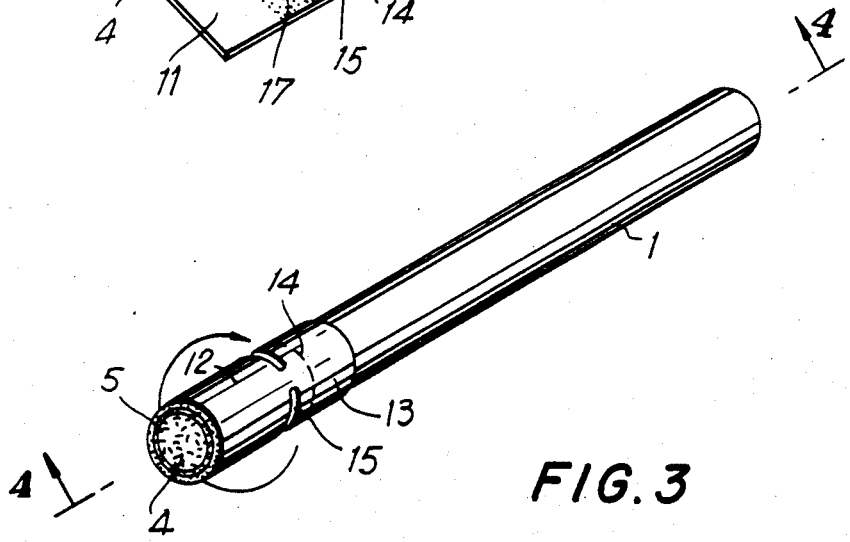
FIG. 3

FIG. 6
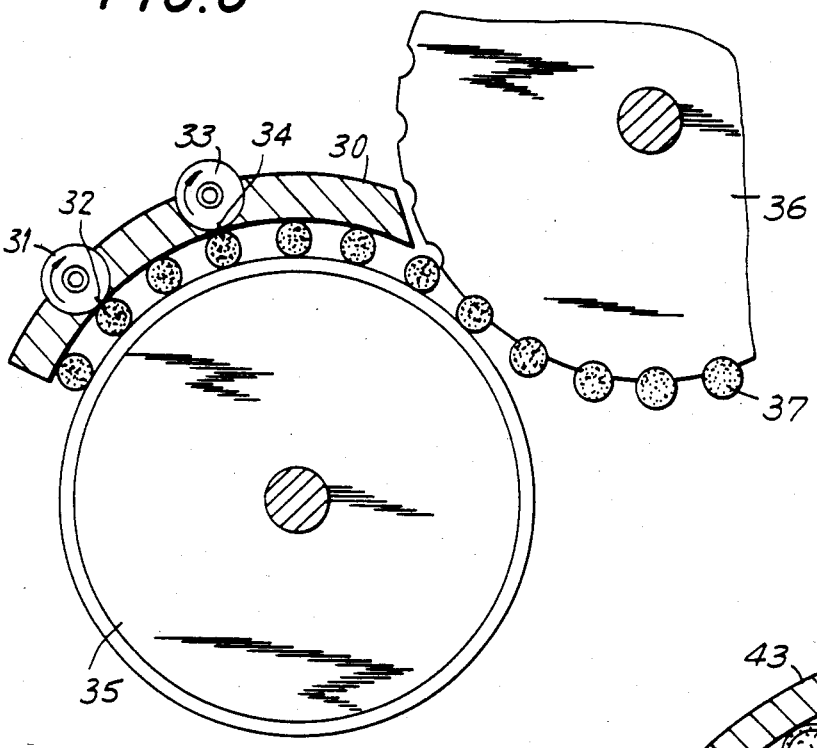
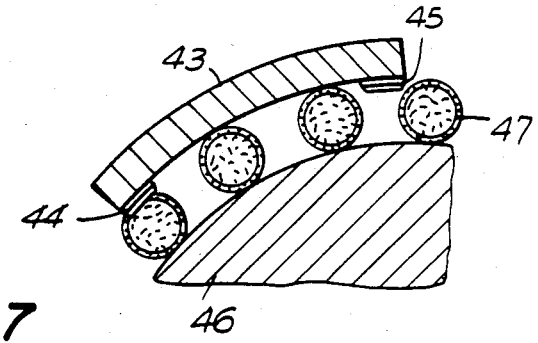
FIG. 7
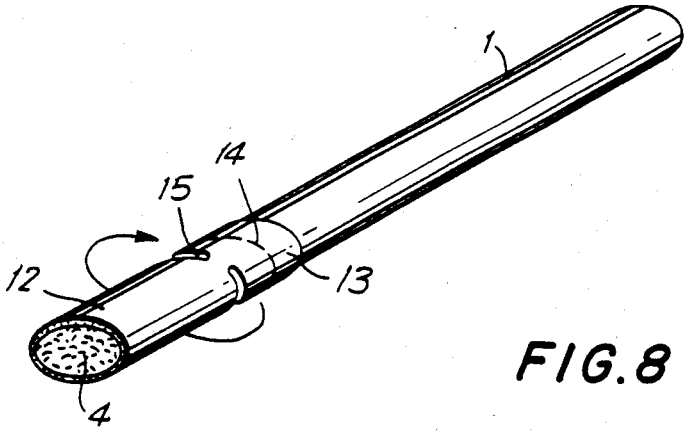
FIG. 8

METHOD OF MAKING A FILTER CIGARETTE

CROSS-REFERENCE TO RELATED APPLICATIONS

This application is a division of copending U.S. patent application Ser. No. 582,600, filed Feb. 22, 1984, now U.S. Pat. No. 4,570,649 which is a continuation-in-part of copending U.S. patent application Ser. No. 429,354, filed Sept. 30, 1982, now abandoned.

FIELD OF THE INVENTION

The present invention relates to filter cigarettes. More particularly, the present invention relates to filter cigarettes which are adjustable by the smoker to vary the air dilution value of the cigarette.

BACKGROUND OF THE INVENTION

Various mechanisms have been disolosed in heretofore issued patents which provide for adjustment of the air dilution vaue of a filter cigarette, but these mechanisms are not without certain disadvantages. While many complicated mechanisms have been disclosed, the simpler mechanisms generally involve making one or more openings through a substantially air-impermeable fiter plug wrap and the overlying, substantially air-impermeable tipping paper and one or more corresponding openings in a sleeve which is placed over the tipping paper and which is then either rotated or moved axially to select the degree to which the two sets of openings are in registry. In another embodiment found in the art, the filter is not glued to the tipping paper and thus may be moved axially within the cylinder formed by the tipping paper. Openings are made in the tipping paper and corresponding openings may be made in the filter plug wrap. The air dilution value is adjusted by axially moving the filter plug within the tipping paper to adjust the degree to which the two sets of openings are in registry.

Among the problems associated with such mechanisms are that the sleeve or filter plug may be removed from the cigarette by the smoker and cannot be readily replaced. Also when dilution is desired, the registry between the two sets of openings may be inadvertantly destroyed by slight axial movement of the sleeve or plug. Accordingly, the dilution, once set by the smoker, is not insured of any degree of consistency. Yet another problem associated with a number of these prior devices is that they have not been readily adaptable to a high rate of production on cigarette making machinery of conventional design.

Accordingly, it is an object of the present invention to provide a filter cigarette which can be readily manufactured on conventional cigarette making equipment and that is adjustable to vary the ratio of air to smoke delivered to the mouth of the smoker.

SUMMARY OF THE INVENTION

A filter cigarette is provided which comprises a substantially cylindrical tobacco rod, that is, a charge of tobacco wrapped in cigarette paper, an integral, axially aligned, substantially cylindrical wrapped filter plug at the mouth end of the tobacco rod, and tipping paper surrounding the filter plug. The tobacco rod and the wrapped filter plug have substantially the same cross-sectional area and shape, which may be either a circular or an ovoid shape. The filter plug has first and second ends, which are open to permit the passage of air and smoke. The plug wrap is divided into a mouth-end band, a central band, and a rod-end band having a first opening. The first and third bands are attached to the filter. The tipping paper circumscribes the filter plug and extends from the mouth end of the filter plug to a position on the tobacco rod adjacent the rod end of the filter plug. The tipping paper is divided into first and second bands, the first band extending from the mouth end of the filter plug to a position adjacent the tobacco rod overlying the rod-end band of the plug wrap. The second band of the tipping paper abuts the first band of the tipping paper and overlaps and attaches the rod end of the filter plug to the abutting end of the tobacco rod. The first band of the tipping paper has a second opening. The first band of the tipping paper is attached to the plug wrap only at the central band for rotation therewith about the longitudinal axis of the filter plug, whereby the second opening is rotated into varying degrees of registry with the first opening to permit varying amounts of air to combine with the smoke, thereby varying the air dilution value of the cigarette. The air dilution value is the ratio of the volume of air to the volume of smoke exiting the mouth end of the filter plug and is expressed as a percentage.

BRIEF DESCRIPTION OF THE DRAWINGS

FIG. 1 is an enlarged, fragmentary, perspective view, taken from the mouth end, of a wrapped filter plug and a tobacco rod for use in the manufacture of variable dilution cigarettes of the present invention.

FIG. 2 is an enlarged, fragmentary, perspective view, taken from the mouth end, of the elements of a variable dilution filter cigarette of the present invention.

FIG. 3 is a perspective view, taken from the mouth end, of the assembled cigarette shown in FIG. 2.

FIG. 6 is a partial, elevational view of an apparatus for use in making perforations in the tipping paper and inner wrappings of the cigarettes of the present invention.

FIG. 7 shows an alternate embodiment of the apparatus of FIG. 6 for use in making a plurality of openings in the tipping paper and inner wrappings of the cigarettes of the present invention.

FIG. 8 is a perspective view, taken from the mouth end, of an oval, variable dilution, filter cigarette of the present invention.

DESCRIPTION OF THE PREFERRED EMBODIMENTS

Figure 4:
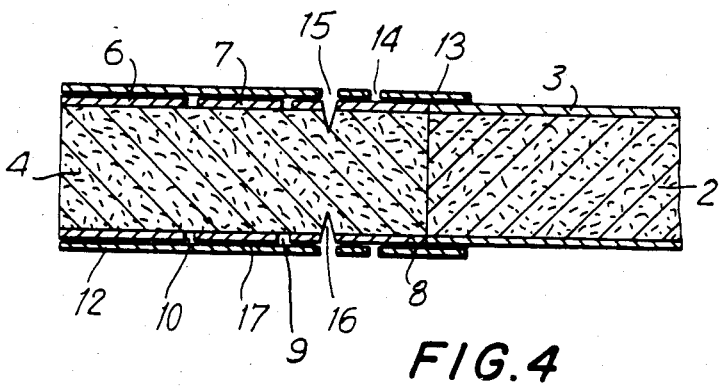
FIG. 4 is a cross-sectional view taken along the line 4—4 of FIG. 3.

The present invention will now be described with reference to the figures in which like elements are given like reference characters throughout.

One preferred embodiment of the present invention, as shown in FIGS. 1, 2, 3, and 4, comprises a substantially cylindrical tobacco rod 1 which comprises a charge of tobacco 2 wrapped in cigarette paper 3 that is axially aligned with and joined in abutting, end-to-end relation to a conventional, substantially cylindrical filter plug 4, which may be a cellulose acetate filter or the like. The filter plug is wrapped in a substantially air-impermeable plug wrap 5 which comprises a mouth-end band 6, a central band 7, and a rod-end band 8, defined by circumferentially extending parallel rows 9 and 10 of spaced perforations. The tobacco rod 1 and the wrapped filter plug have substantially the same cross-sectional area and shape. In the embodiment shown in FIGS. 1, 2, 3 and 4, the cigarette has a conventional, circular cross-section. The wrapped filter plug is joined to the tobacco rod 1 by substantially air-impermeable tipping paper 11. The rod-end band 8 has an opening 16 therein. Mouth-end band 6 and rod-end band 8 are attached to the filter plug and central band 7 is freely rotatable about the longitudinal axis of the cigarette.

Tipping paper 11 is divided into a first band 12 and a second band 13 by a circumferentially extending row of closely spaced perforations 14. The inner surface of the first band 12 is attached to the outer surface of central band 7, preferably by a ribbon of adhesive material 17, for rotation with central band 7 about the longitudinal axis of the cigarette when the rows of perforations 9, 10 and 14 are broken. The inner surface of the second band 13 is attached to the outer surfaces of tobacco rod 1 and the rod-end band, preferably by a ribbon of adhesive material 18. An opening 15 is formed in the first band 12 at a position which overlies the rod-end band 8.

As the first band 12 is rotated, the rows of perforations 9, 10 and 14 are broken and the opening 15 is rotated into varying degrees of registry with the opening 16 in the underlying plug wrap. Thus the amount of air entering the filter, where it is mixed with the smoke produced by the burning tobacco 2, can be selected by adjusting the degree to which the openings 15 and 16 are in registry. Central band 7 and thus the first band 12 are retained against axial movement by bands 6 and 8 and this, in conjunction with the frictional resistance to rotation, insures that the degree of dilution, once selected, is maintained.

The method of the present invention is such that the cigarette may be readily produced on conventional cigarette making equipment and tipping apparatus with a minimum of modification. Forming and cutting the cigarette rod and forming and cutting the filter plug to length are done conventionally. Also, bringing the filter plug into axial alignment with the cigarette rod and overwrapping with tipping paper are accomplished in the same manner as in conventional cigarettes.

Furthermore, additional simplicity in manufacturing is made possible in the present invention by simultaneously forming the openings in the tipping paper and inner wrappings. This is accomplished, in one manner, simply by slitting or perforating the tipping paper and underlying wrappings on each cigarette as it passes through the conventional cigarette making machinery at or near a rolling shoe station. A means for permitting the smoker to select the specific smoke to air dilution ratio desired may be provided through indicia which are printed on the tipping paper during the passage of the cigarette through the tipping apparatus. Such indicia are made readily visible and are designed to show the degree of registry of the openings.

The perforations 14 in the tipping paper and the perforations 9 and 10 of the plug wrap may be made by conventional means such as laser perforation or by using points or knives. It is preferred to employ a laser perforation device in order to make the perforations extremely small and minimize the possibility of even a slight axial slip in the assembled cigarette. Preferably, the laser system is employed to make about 100 perforations per inch. The power settings and focusing of the laser and the rate of feed of the paper or plug wrap are selected so as to all but part the paper along the "break away" lines. The attachment which remains is selected to retain only sufficient strength to hold the bands together during assembly.

Figure 5:
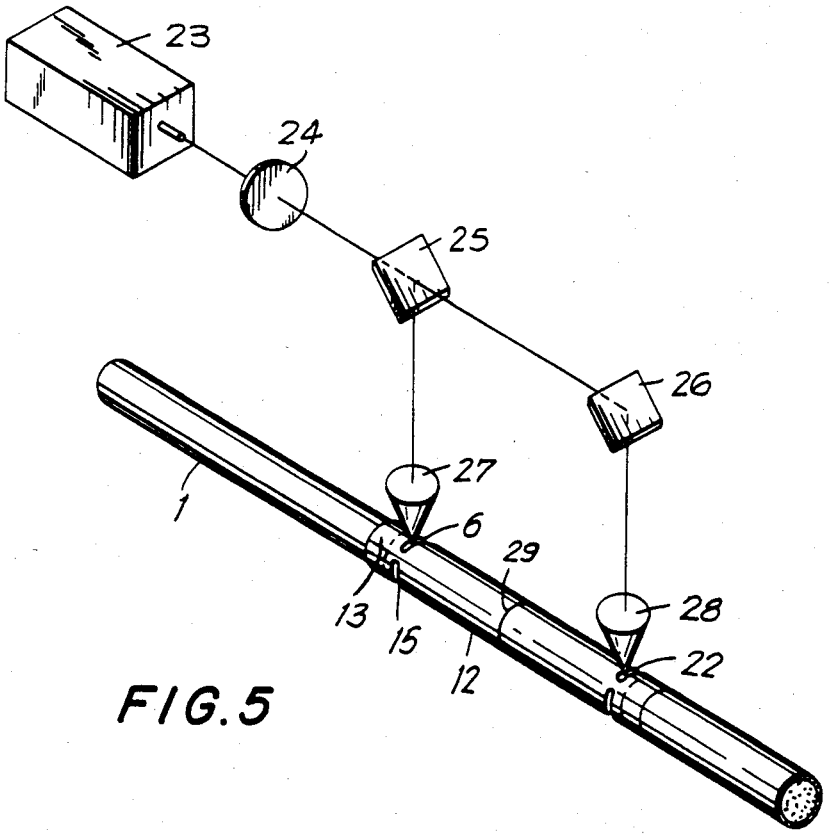
FIG. 5 is a view in perspective of a laser system for use in making the openings in the tipping paper and underlying plug wrap.

The perforated tipping paper is applied to the cigarette making machine in which an appropriately perforated double length filter is positioned between the two tobacco rods, as in FIG. 5. The modification required in order to make the embodiments of the present invention using this conventional equipment is minor in that the adhesive applicator is adapted to provide ribbons or the like of adhesive which correspond with the ribbons of adhesive 17 and 18 on the single width tipping paper of FIG. 2. A double width of paper to which the adhesive has been applied is wrapped around the two cigarette rods and intermediate filter, then the openings are made in the tipping paper and the underlying plug wrap using conventional equipment, and then the tipping paper and filter are severed through the center 29 of the double filter to form two filter cigarettes.

Preferably, as shown in FIG. 5, a laser perforation system is employed which uses a laser 23 to generate a laser beam that is passed through an initial focusing lens 24, then divided by beam splitter 25. One half of the beam passes through lens 27 and is focused on the tipping paper to form opening 15 while the second half of the beam is reflected by mirror 26 through lens 28 which focuses the second beam onto the tipping paper to form opening 22. The laser beam is focused to traverse the rotating cigarette and is set to remain on for a time period sufficient to make a slit of a desired length through the tipping paper and the underlying plug wrap. Slits one millimeter wide are preferred. If it is desired to establish a line of perforations instead of slits, the laser beam may be pulsed a given number of times to provide a line of separate holes. Once the openings are formed, the filter is severed at line 29 to form two cigarettes.

The openings in the tipping paper and the underlying plug wrap may also be made by mechanical means as shown in FIGS. 6 and 7. As shown in FIG. 6, cigarettes 37 are passed between rotating drums 35 and 36 which feed the cigarettes beneath a fixed plate 30 and into contact with a rotating perforation device comprising rotating wheels 31 and 33 which have pin-like projections 32 and 34 that penetrate the tipping paper and plug wrap and also penetrate a short distance within the filter.

As shown in FIG. 7, a device equivalent in function to that shown in FIG. 6 is disclosed which employs a fixed plate 43 and a rotating drum 46 and has knife-like projections 44 and 45 which make slits through the tipping paper and plug wrap of cigarettes 47. Very thin bades or finely pointed elements are used so that the vents are made to appear virtually invisible to the naked eye when observed by the smoker. One millimeter wide slits are preferred.

Another preferred embodiment of the present invention is shown in FIG. 8 and differs from the embodiment shown in FIGS. 1, 2, 3 and 4 in having an ovoid cross-section. The crosssectional area and shape of the tobacco rod and the wrapped filter plug are substantially the same and the tobacco rod and wrapped filter plug are joined to each other in abutting, end-to-end relation such that the cross-sections are in registry.

It will be understood that the particular embodiments described above are only illustrative of the principles of the present invention, and that various modifications can be made by those skilled in the art without departing from the scope and spirit of the present invention.

We claim:

1. A method of making a filter cigarette comprising a substantially cylindrical tobacco rod, a substantially cylindrical filter plug, plug wrap circumscribing the filter plug, and tipping paper circumscribing the plug wrap and a portion of the tobacco rod, at least one of said plug wrap and said tipping paper being substantially air-impermeable, wherein the tobacco rod and the wrapped filter plug have substantially the same cross-sectional area and shape, the filter plug has a rod end and a mouth end open to permit passage of air and smoke, the tobacco rod and the wrapped filter plug are axially aligned in abutting, end-to-end relation, the plug wrap comprises, in sequence, abutting mouth-end, central, and rod-end bands, the rod-end band has a first opening therein, the rod-end band and the mouth-end band are fixed to the filter plug, the central band is rotatable about the longitudinal axis of the filter plug, the tipping paper comprises a first band and an abutting second band, the first band extends from the mouth end of the filter plug to a position overlying the rod-end band and is attached only to the central band for rotation therewith, the first band has a second opening therein positioned such that rotation of the first band rotates the second opening into varying degrees of registry with the first opening, and the second band extends from the first band to a position on the tobacco rod and joins the tobacco rod to the wrapped filter plug; said method comprising:

making two parallel, circumferentially extending rows of closely spacely perforations in the plug wrap to define the mouth-end, the central, and the rod-end bands, one of said rows spaced from said mouth end and defining said mouth-end and central bands, the second of said rows spaced from the first of said rows and defining said central and rod-end bands, axially aligning the tobacco rod and the wrapped filter plug in abutting end-to-end relation, making a row of perforations in the tipping paper to define the first and the second bands, applying an adhesive on one side of the tipping paper at a first position overlying the tobacco rod and the portion of the rod-end band to be circumscribed by the second band, and at a second position corresponding to the location of the central band, wrapping the adhesive-coated side of the tipping paper around the axially aligned tobacco rod and filter plug, and forming an opening in the first band and the underlying rod-end band.

2. A method of making a filter cigarette comprising a substantially cylindrical tobacco rod, a substantially cylindrical filter plug, plug wrap circumscribing the filter plug, and tipping paper circumscribing the plug wrap and a portion of the tobacco rod, at least one of said plug wrap and said tipping paper being substantially air-impermeable, wherein the tobacco rod and the wrapped filter plug having substantially the same cross-sectional area and have ovoid cross sections in registry, the filter plug has a rod end and a mouth end open to permit passage of air and smoke, the tobacco rod and the wrapped filter plug are axially aligned in abutting, end-to-end relation, the plug wrap comprises, in sequence, abutting mouth-end, central, and rod-end bands, the rod-end band has a first opening therein, the rod-end band and the mouth-end band are fixed to the filter plug, the central band is rotatable about the longitudinal axis of the filter plug, the tipping paper comprises a first band and an abutting second band, the first band extends from the mouth end of the filter plug to a position overlying the rod-end band and is attached only to the central band for rotation therewith, the first band has a second opening therein positioned such that rotation of the first band rotates the second opening into varying degrees of registry with the first opening, and the second band extends from the first band to a position on the tobacco rod and joins the tobacco rod to the wrapped filter plug; said method comprising:

making two parallel, circumferentially extending rows of closely spaced perforations in the plug wrap to define the mouth-end, the central, and the rod-end bands, one of said rows spaced from said mouth end and defining said mouth-end and central bands, the second of said rows spaced from the first of said rows and defining said central and rod-end bands, axially aligning the tobacco rod and the wrapped filter plug in abutting end-to-end relation, making a row of perforations in the tipping paper to define the first and the second bands, applying an adhesive on one side of the tipping paper at a first position overlying the tobacco rod and the portion of the rod-end band to be circumscribed by the second band, and at a second position correponding to the location of the central band, wrapping the adhesive-coated side of the tipping paper around the axially aligned tobacco rod and filter plug, and forming an opening in the first band and the underlying rod-end band.

* * * * *

UNITED STATES PATENT AND TRADEMARK OFFICE

CERTIFICATE OF CORRECTION

PATENT NO. : 4,638,818

DATED : January 27, 1987

INVENTOR(S) : Walter A. Nichols et al.

It is certified that error appears in the above-identified patent and that said Letters Patent is hereby corrected as shown below:

Column 1, line 21, "vaue" should be -- value --.

Column 4, line 54, "bades" should be -- blades --.

Signed and Sealed this

Fourteenth Day of April, 1987

*Attest:*

DONALD J. QUIGG

*Attesting Officer*

*Commissioner of Patents and Trademarks*